US007066638B1

(12) United States Patent
Heidler

(10) Patent No.: US 7,066,638 B1
(45) Date of Patent: Jun. 27, 2006

(54) FLEXIBLE MIXING MAT AND METHOD OF USE

(76) Inventor: Ralph Heidler, 702 W. M.L. King Blvd., Plant City, FL (US) 33566

( * ) Notice: Subject to any disclaimer, the term of this patent is extended or adjusted under 35 U.S.C. 154(b) by 554 days.

(21) Appl. No.: 09/626,804

(22) Filed: Jul. 27, 2000

Related U.S. Application Data

(63) Continuation-in-part of application No. 09/365,630, filed on Aug. 2, 1999, now abandoned.

(51) Int. Cl.
*B28C 5/44* (2006.01)

(52) U.S. Cl. ..... 366/2; 366/53; 366/129; 366/348; 366/349; 383/10

(58) Field of Classification Search ..... 366/1, 366/2, 3, 4, 6, 8, 129, 130, 349, 348, 53; 383/4, 120, 6, 7, 10, 17; 206/219
See application file for complete search history.

(56) References Cited

U.S. PATENT DOCUMENTS 2,312,444 A * 3/1943 Rochford et al. ..... 366/349
2,603,264 A * 7/1952 Cautley ..... 383/4
3,024,824 A * 3/1962 Bass ..... 383/4
4,500,129 A * 2/1985 Hahn ..... 383/4
4,580,372 A * 4/1986 Osborn
4,682,447 A * 7/1987 Osborn ..... 383/4
4,938,607 A * 7/1990 Kelley ..... 383/4
5,328,265 A * 7/1994 Clooney ..... 383/4
RE34,849 E * 2/1995 Sanders ..... 383/4
5,743,636 A * 4/1998 Payne ..... 366/129

* cited by examiner

*Primary Examiner*—Tony G. Soohoo

(57) ABSTRACT

A flexible mixing mat comprising a geometrically-shaped planar substrate having four corner areas which have been removed and replaced with four expandable corners coupled to the four corner areas, respectively. Each expandable corner, a pleated flexible member, expands greater than that area having been removed. Further included are handles formed in or connected to each expandable corner. A method of using the flexible mixing mat to mix ingredients such as ingredients for creating cement is provided.

17 Claims, 4 Drawing Sheets

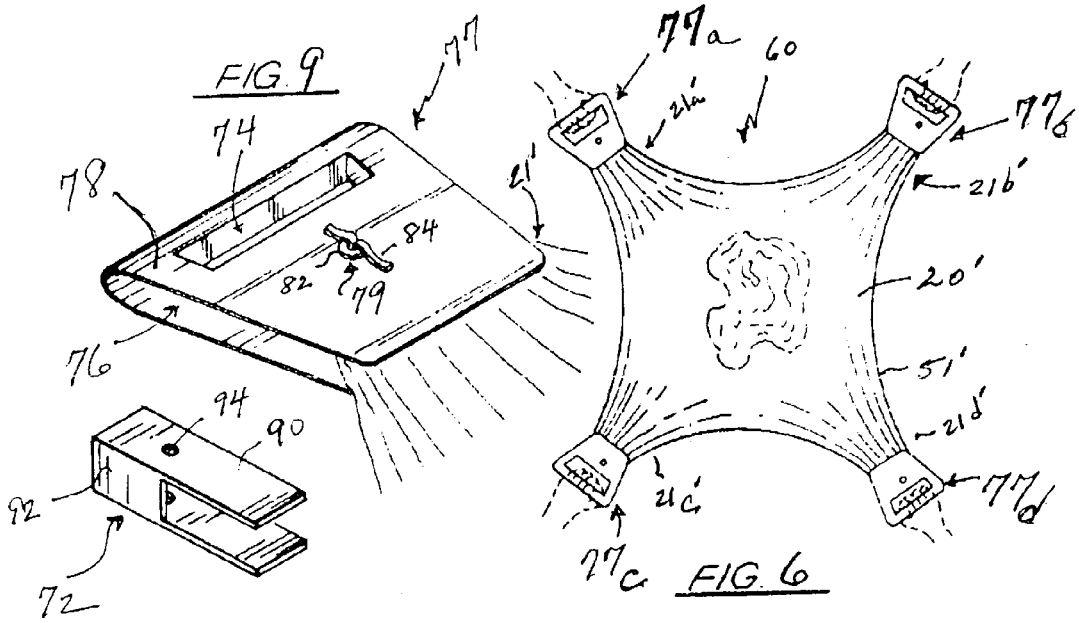
FIG. 9
77
74
78
84
82
79
76
21'
94
90
92
72
77a
60
21a'
77b
21b'
20'
51'
21d'
21c'
77d
77c
FIG. 6
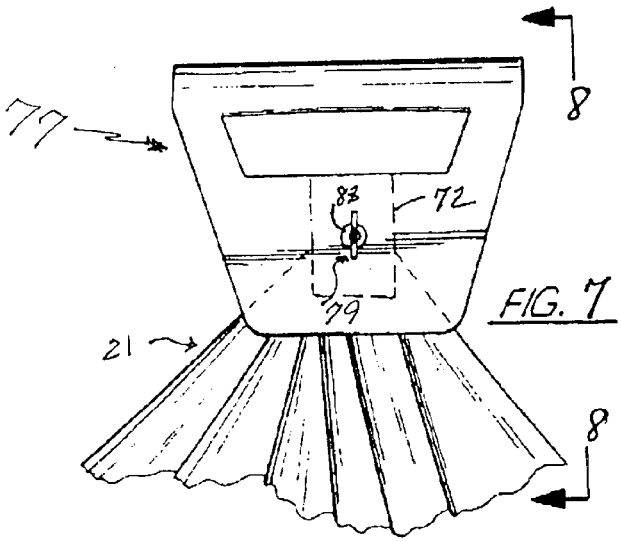
FIG. 10
77
8
83
72
79
21
8
FIG. 7
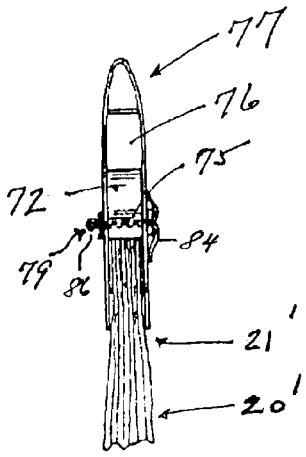
77
76
75
72
84
79
82
21'
20'
FIG. 8

FIG. 12
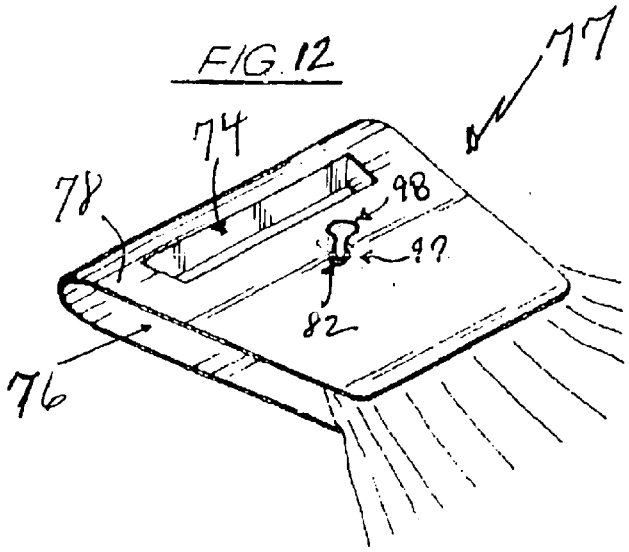
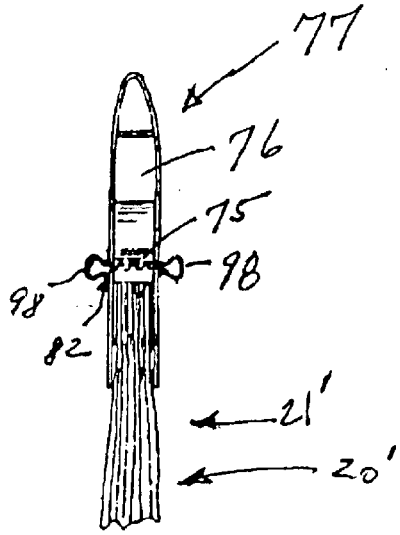
FIG. 11

FLEXIBLE MIXING MAT AND METHOD OF USE

This application is a continuation-in-part application of a patent application by the same inventor bearing U.S. Ser. No. 09/365,630, filed Aug. 2, 1999 now abandoned, and entitled "Flexible Mixing Mat Including Fanning Corners With Handles And Method Of Use". The entire application U.S. Ser. No. 09/365,630 is incorporated herein by reference as if set forth in full herein.

BACKGROUND OF THE INVENTION

1. Field of the Invention

The present invention relates to mixing mats such as for mixing cement and, more particularly, to a flexible mixing mat including fanning corners with handles.

2. General Background

Supplies for do-it-your-self home improvements has become big business and readily accessible to all. Most supply depots even provide instructions for carrying out just about any home improvement imaginable. However, some of the home improvements may require complex machinery for preparing the materials. One such material is cement. Cement can be mixed in small batches for creating small foundations or other structures as desired. However, the cement must be mixed. Typically cement is a powdery composition which is to be mixed with water to form the cement. However, as the powdery composition must be mixed to fully dissolve all the powder of the composition.

Several apparatuses have been patented which are aimed at cement mixing devices.

U.S. Pat. No. 5,743,636, issued to W. L. Payne, entitled "MIXING MAT FOR CONCRETE," discloses an apparatus and a method for mixing dry pre-blended cement compositions. The apparatus comprises a flexible mixing mat (being of either a rectangular or ovoid shape) having a central basin, a skirt, pouring lip and a handle in each of the corners near the mat's edge. The method or process includes mixing water with a pre-blended bag of cement in the central basin, then having two persons pick up mat by the corner handles and agitate the mixture by raising and lowering the handles and finally pouring the mixture from the mat via the pouring lip.

International Application (PCT) Publication No. WO 89/00884 filed by K. Eriksson, entitled "MIXING DEVICE, "discloses an apparatus and method comprising a tube or mat having holes which form handles at the ends of the tube so that a batch of cement placed in the interior of the tube can be mixed by manually agitating the tube.

U.S. Pat. No. 3,860,219, entitled "PROCESS FOR MANUALLY MIXING CEMENT," and No. 4,470,703, entitled "PROCESS FOR MIXING AND RETARDING CURE OF CEMENT," both of which are issued to B. W. Nickerson, disclose processes for manually mixing batches of dry cement and water in a pliable bag closed before mixing.

Other patents in the art include U.S. Pat. No. 2,323,444, issued to Rochford et al., entitled "MIXING MACHINE" and U.S. Pat. No. 5,290,100, issued to Kleinbans, entitled "METHOD OF MIXING PROPELLANT CHARGE POWDER RODS" which do not meet the needs of the present invention.

SUMMARY OF THE PRESENT INVENTION

The preferred embodiment of the flexible mixing mat of the present invention solves the aforementioned problems in a straight forward and simple manner.

Broadly, what is provided is a flexible mixing mat comprising: a geometrically-shaped planar substrate having four corner areas; four expandable corners coupled to said four corner areas, respectively; and, handle means provided in a respective one of said four expandable corners from which said geometrically-shaped planar substrate is adapted to be lifted. The handle means can comprise: oblong apertures wherein a respective oblong aperture is formed in a respective one of said four expandable corners from which said geometrically-shaped planar substrate is adapted to be lifted; or, U-shaped channels connected to a respective one of said four expandable corners by fastener means, such as pins or plugs.

In view of the above, an object of the present invention is to provide each corner area of said four corner areas of said geometrically-shaped planar substrate with a triangularly-shaped notch having an apex located a distance from an edge of said geometrically-shaped planar substrate. Moreover, each expandable corner of said four expandable corners comprises a pleated flexible member expandable greater than said triangularly-shaped notch wherein said pleated flexible member has formed therein said respective oblong aperture and wherein a center of a longitudinal length of said oblong aperture is substantially aligned with said apex.

Another object of the present invention is to provide a flexible mixing mat with a geometrically-shaped planar substrate which is rectangularly shaped.

A further object of the present invention is to provide a flexible mixing mat with a triangularly-shaped notch which is an acute angle notch having one leg perpendicular to a short edge of the rectangular planar substrate.

It is a still further object of the present invention to provide a flexible mixing mat which is made of flexible and waterproof material such as without limitation tarpaulin material.

It is a still further object of the present invention to provide a flexible mixing mat with expandable corners having an apex wherein each apex is adapted to create a folding point and wherein pairs of said apexes form folding lines.

It is a still further object of the present invention to provide a method of mixing ingredients using a flexible mixing mat comprising a geometrically-shaped planar substrate having four corner areas; four expandable corners coupled to said four corner areas, respectively; and, oblong apertures wherein a respective oblong aperture is formed in a respective one of said four expandable corners and forms a handle, said method comprising the steps of:

(a) placing a given amount of a first ingredient of a mixture substantially in a center of said geometrically-shaped planar substrate;

(b) adding a given amount of a second ingredient to said first ingredient to create a mixture;

(c) lifting said geometrically-shaped planar substrate by said handle means of each expandable corner; and, (d) agitating said geometrically-shaped planar substrate until substantially said mixture of said first and second ingredients is substantially dissolved or homogenous forming a mixed mixture.

It is a still further object of the present invention to provide a method further comprising the step of: (e) tilting said geometrically-shaped planar substrate and pouring the mixed substance.

It is a still further object of the present invention to provide a method for mixing cement wherein said first ingredient is a dry pre-blended cement composition, said second ingredient is water, said mixture is a slurry and said mixed mixture is cement.

It is a still further object of the present invention to provide a method of mixing ingredients which are essentially dry and do not require water.

In view of the above objects, it is a feature of the present invention to provide a flexible mixing mat which is easy to use.

Another feature of the present invention is to provide a flexible mixing mat which is relatively simple structurally and thus simple to manufacture.

It is another feature of the present invention to provide a flexible mixing mat which enhances the control of the mixture or slurry placed thereon via expandable corners from which the mat is held.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein:

FIG. 6 is a top plan view of an alternate embodiment (in use) of the flexible mixing mat of FIG. 1;

FIG. 7 is an enlarged plan view of an expandable corner and handle means of the embodiment of FIG. 6;

FIG. 8 is a cross-sectional view taken through the Line 8—8 of FIG. 7;

FIG. 9 is a top perspective view of an expandable corner and handle of the embodiment FIG. 6;

FIG. 10 is a top perspective view of the spacer member of the handle means of the embodiment FIG. 6;

FIG. 11 is a cross-sectional view through the Line 8—8 of FIG. 7, but with an alternate fastening means;

FIG. 12 is the top perspective view of the expandable corner and handle means seen in FIG. 9, but with an alternate fastening means.

DETAILED DESCRIPTION OF THE PREFERRED EMBODIMENT

Figure 1:
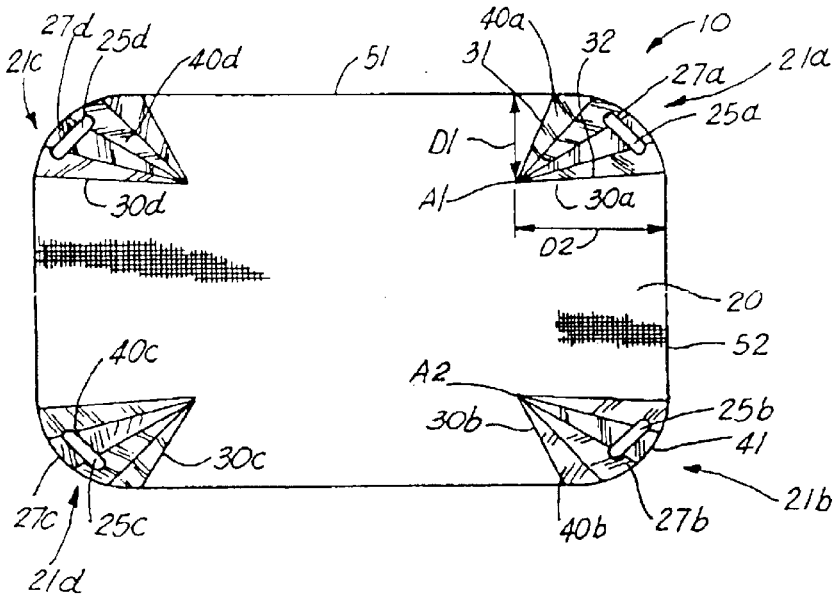
FIG. 1 illustrates a top view of the flexible mixing mat of the preferred embodiment of the present invention.
Figure 2:
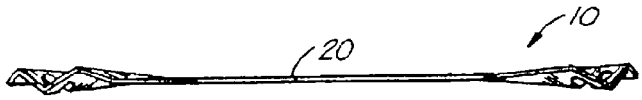
FIG. 2 illustrates a side view of the flexible mixing mat of the preferred embodiment of the present invention.
Figure 3:
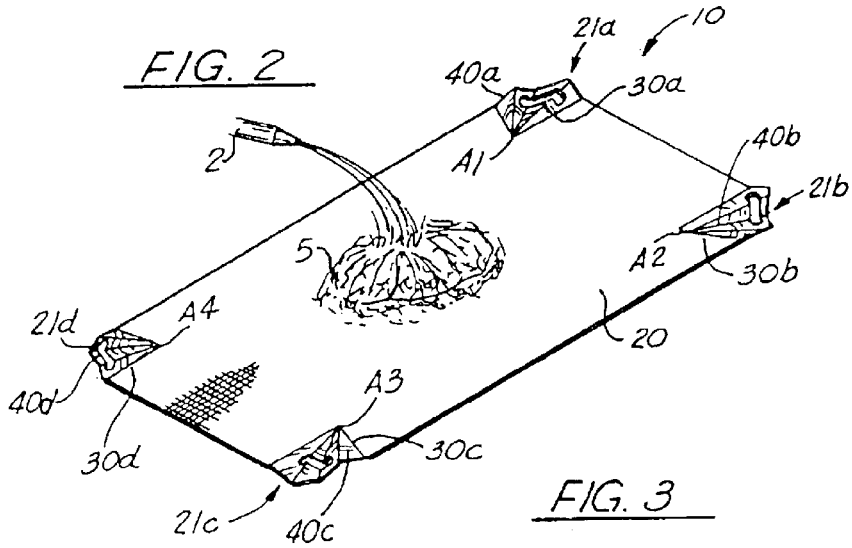
FIG. 3 illustrates a perspective view of the flexible mixing mat of the preferred embodiment of the present invention.

Referring now to the drawing and in particular FIGS. 1–3, the flexible mixing mat of the preferred embodiment of the present invention is generally referenced by the numeral 10. In general flexible mixing mat 10 is designed to mix dry cement compositions or other granular mixtures which may require a fluid additive. Nevertheless, the flexible mixing mat can be used to mix other compositions which can be mixed by folding, shaking and/or agitation so that the composition becomes essentially homogenous and/or dissolved. For illustrative purposes, flexible mixing mat 10 is used for mixing dry pre-blended cement compositions 5.

In the preferred embodiment, flexible mixing mat 10 comprises a geometrically-shaped planar substrate 20 (being of either a rectangular or ovoid shape) made of flexible and waterproof material. Flexible mixing mat 10 has four (4) expandable corners 21*a*, 21*b*, 21*c* and 21*d* and four (4) oblong apertures 25*a*, 25*b*, 25*c* and 25*d* formed in such expandable corners 21*a*, 21*b*, 21*c* and 21*d*, respectively. The four (4) expandable corners 21*a*, 21*b*, 21*c* and 21*d* are truncated such that the otherwise point of the corners are eliminated and preferably, truncated to created rounded corners. The four (4) oblong apertures 25*a*, 25*b*, 25*c* and 25*d* are arranged in such a manner with respect to the rounded four (4) expandable corners 21*a*, 21*b*, 21*c* and 21*d* so that handles 27*a*, 27*b*, 27*c*, and 27*d*, respectively, are formed. Thereby, the user or users are capable of placing their hands in the four (4) oblong apertures 25*a*, 25*b*, 25*c* and 25*d* and lift the geometrically-shaped planar substrate 20.

In the preferred embodiment, the geometrically-shaped planar substrate 20 is essentially a rectangularly shaped and is fifty four (54") inches wide and eighty four (84") inches long. Nevertheless, the geometrically-shaped planar substrate 20 may be square shaped or any other shape.

The expandable capability of the four expandable corners 21*a*, 21*b*, 21*c* and 21*d* is created by pleated flexible members 40*a*, 40*b*, 40*c*, and 40*d*, respectively, inserted in a respective one of triangularly-shaped notches 30*a*, 30*b*, 30*c*, and 30*d* formed in the geometrically-shaped planar substrate 20 at the corners thereof whereby the corners are not truncated by instead are removed. The triangularly-shaped notch 30 is created by the removal of a triangularly-shaped portion of the geometrically-shaped planar substrate 20.

Since each triangularly-shaped notch is essentially identical, only one such triangularly-shaped notch will be described in detail. Triangularly-shaped notch 30*a* includes apex A1 positioned distance D1 from edge and a distance D2 from edge 52 of geometrically-shaped planar substrate 20.

In the preferred embodiment, triangularly-shaped notch 30*a* forms a notch which is an acute angled notch. Nevertheless, the triangularly-shaped notch may be a right angled notch. Moreover, in the preferred embodiment, leg 32 of the triangularly-shaped notch 30*a* is essentially perpendicular to edge 52 of the geometrically-shaped planar substrate 20 while leg 31 of the triangularly-shaped notch 30*a* angularly intersects edge 51 of the geometrically-shaped planar substrate 20.

Since each pleated flexible member is essentially identical, only one such pleated flexible member will be described in detail. Pleated flexible member 40*b* is made of flexible material essentially triangularly-shaped. In the preferred embodiment, instead of a generally flat or linearly straight base of the triangularly-shaped pleated flexible member 40*b*, the base 41 is rounded. Oblong aperture 25*b* is formed in the triangularly-shaped pleated flexible member 40*b* whereby the longitudinal center of oblong aperture 25*b* is essentially aligned with apex A2. Apex A2 is the apex of triangularly-shaped notch 30*b*.

While not wishing to be bound by theory, it is believed that the advantageous results of the invention are obtained because apexes A1, A2, A3 and A4 provide automatic folding points from which the geometrically-shaped planar substrate 20 will tend to fold that portion thereof from apexes A1, A2, A3 and A4 to edges 51 and 52 and/or their parallel counter-edges upward as the geometrically-shaped planar substrate 20 is lifted about handles 27*a*, 27*b*, 27*c* and 27*d*. This folding is also in part due to the longitudinal centering of the oblong apertures 25*a*, 25*b*, 25*c* and 25*d* with apexes A1, A2, A3 and A4.

As will be described more clearly, the geometrically-shaped planar substrate 20 will not always fold exactly about apexes A1, A2, A3 and A4 because of the deformable nature of the cement when being mixed. However, when manipulating geometrically-shaped planar substrate 20, as the deformable cement moves closer to edge 51, geometrically-shaped planar substrate 20 will tend to fold about apexes A1 and A4 so that the cement during mixing does not fall to the ground.

Figure 5A:
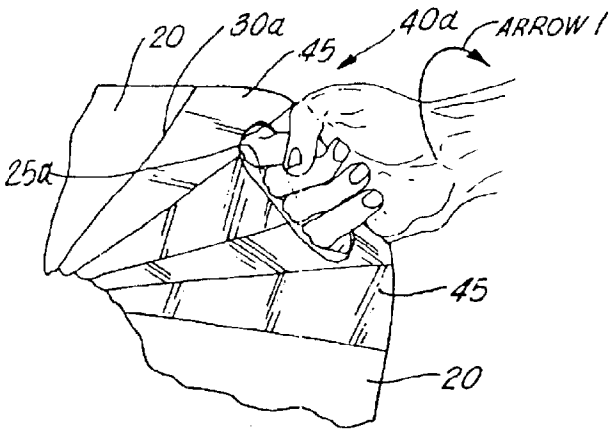
FIG. 5*a* illustrates the twisting movement of the wrist in a first direction for manipulating the flexible mixing mat; and, FIG. 5*b* illustrates the twisting movement of the wrist in a second direction for manipulating the flexible mixing mat.
Figure 5B:
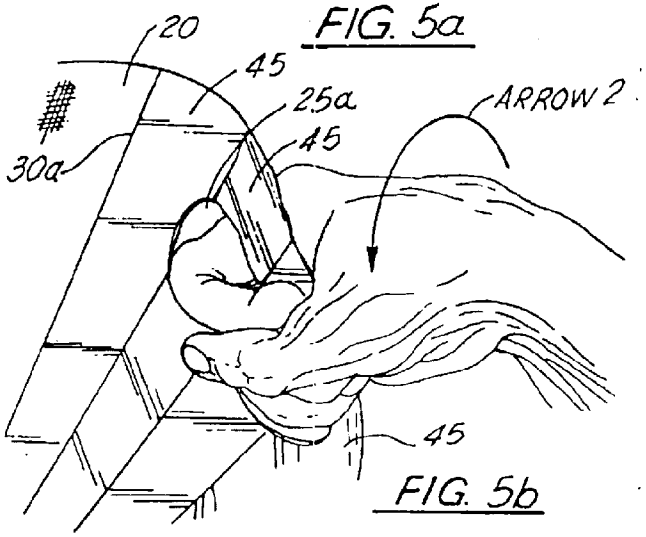

Pleated flexible member 40 includes a plurality of pleats 45, as best seen in FIGS. 5*a* and 5*b*, arranged in a manner similar to that of a fan. In the exemplary embodiment, the distance between A1 and A2 is approximately thirty (30") inches and the distance between A1 and A4 is approximately forty four (44") inches. The surface area between apexes A1, A2, A3 and A4 is the primary mixing area to be used during the mixing process.

While not wishing to be bound by theory, it is believed that the advantageous results of the invention are obtained because of pleated flexible member 40 defined by the plurality of pleats 45 wherein the expandable properties inherent in the fanning of the plurality of pleats 45 enhances the overall control and the overall range of manipulation of flexible mixing mat 10 during the mixing process.

The preferred embodiment of flexible mixing mat 10 is made of a rectangular piece of tarpaulin. The aperture edge defining each of the four (4) oblong apertures 25*a*, 25*b*, 25*c* and 25*d* is preferably reenforced.

Referring now to FIGS. 6–12, the flexible mixing mat of the alternate embodiment of the present invention is generally referenced by the numeral 60.

In the alternate embodiment, flexible mixing mat 60 comprises a geometrically-shaped planar substrate 20'substantially identical to substrate 20 of mat 10 of the preferred embodiment. Flexible mixing mat 60 has four (4) expandable corners 21*a*, 21*b*, 21*c*', 21*d*' and four (4) handle means 77*a*, 77*b*, 77*c* and 77*d* connected to such expandable corners 21', respectively. The four (4) expandable corners 21' are truncated to created rounded corners. The four (4) handle means 77 are connected in such a manner with respect to the rounded four (4) expandable corners 21' whereby the user or users are capable of grasping with their hands the four (4) handles 77 and lift the geometrically-shaped planar substrate 20'.

The expandable capability of the four expandable corners 21' is created by the same pleating inserted in triangularly-shaped notches formed in the geometrically-shaped planar substrate 20' at the corners thereof whereby the corners are not truncated but instead are removed.

In alternate embodiment 60 an aperture 75 is formed in the triangularly-shaped pleated flexible member 40 whereby the longitudinal center of aperture 75 is essentially aligned with apex A. The aperture edge defining each of the four (4) oblong apertures 75 is preferably reenforced.

Apex A2 is the apex of triangularly-shaped notch 30*b*. Thus the same apexes A1, A2, A3 and A4 provide automatic folding points from which the geometrically-shaped planar substrate 20' will tend to fold that portion thereof from apexes A1, A2, A3 and A4 to the edges and/or their parallel counter-edges upward as the geometrically-shaped planar substrate 20' is lifted about handle means 77. This folding is also in part due to the longitudinal centering of the apertures 75, and thus handle means 77, with apexes A1, A2, A3 and A4.

Handle means 77 of the alternate embodiment 60 comprises a generally U-shaped channel 78 defining gap 76 between its sides. A transverse slot 74 is provided through channel 78 near its proximate or outer end to aid the user in grasping mat 60 for mixing operations and an aperture 82 is provided through channel 78 near the center region thereof. Both slot 74 and aperture 82 pass through both sides of channel 78 in alignment. A spacer member 72, best seen in FIG. 10, is provided in gap 76 to reinforce handle means 77 and its connection to substrate 20'. Spacer member 72 has two opposing sides 90 and two opposing truncated sides 92 and is open at the top and bottom and has an aperture 94 passing through sides 90 in alignment and in alignment with aperture 82 in channel 78. Grommets 83, passing through apertures 82 and 94 in each side of channel 78 fix spacer member 72 in gap 76.

Thus, as is best illustrated in FIGS. 7 and 8, when spacer member 72 is positioned in gap 76 and respective corner 21' is inserted in spacer member 72 such that apertures 82 and 94 align with aperture 75 in respective corner 211, a fastening means can be placed therethrough to connect handle means 77 to corner 21'. Handle means 77 and spacer member 72 may be made of either plastic or metal.

In FIGS. 7–9 a conventional cotter pin 79 is the fastening means and has a head 86 and integral prongs 84, prongs 84 being bent over on one side of channel 78 to secure the connection of handle means 77 to corner 21'. In FIGS. 11–12 a conventional expandable rubber plug 97 is the fastener means and has a body integral with bulbous ends 98 which protrude from aperture 82 to prevent removal so as to secure the connection of handle means 77 to corner 21'.

Figure 4A:
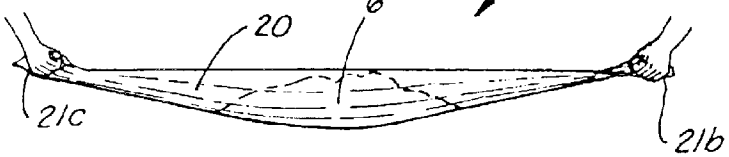
FIG. 4*a* illustrates the initial positioning of the cement for carrying out the method of mixing the cement.
Figure 4B:
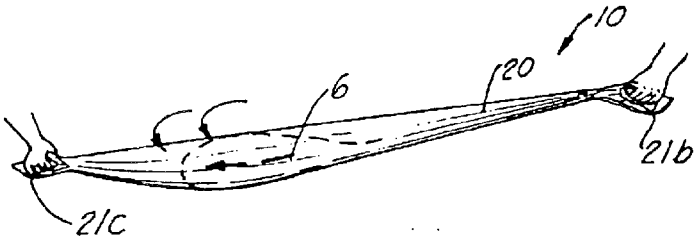
FIG. 4*b* illustrates the rolling of the cement in one direction for carrying out the method of the present invention.
Figure 4C:
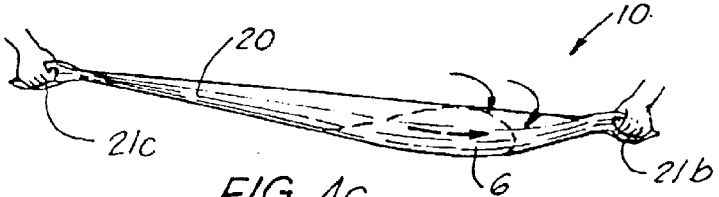
FIG. 4*c* illustrates the rolling of the cement in another direction for carrying out the method of the present invention.

Referring now to FIGS. 4*a*–4*c*, the preferred embodiment of the method of the present invention (and therefore, the operation of flexible mixing mats 10 and 60, although only mat 10 will be used for describing the method) has the following steps (not necessarily in the order listed, as variations can take place):

1. A given amount of "ready mix" concrete 5 is place on geometrically-shaped planar substrate 20 in the area between A1–A4, as best seen in FIG. 3;
2. Water is added, such as via a hose 2 (FIG. 3) so that approximately 2 gallons are mixed with a standard industrial bag of "ready mix" (90 lb.) resulting in slurry 6 on geometrically-shaped planar substrate 20;
3. Two workmen each grasp one side of geometrically-shaped planar substrate 20 by pairs of handles 27*a*, 27*b* and 27*c*, 27*d* and lift so that geometrically-shaped planar substrate 20 is about waist-high and takes the shape illustrated in FIG. 4*a* (one workman can accomplish this by tying the opposing handles to a hook inserted in a wall at waist level);
4. Violently agitating geometrically-shaped planar substrate 20 for about 15–30 seconds or until substantially all the "ready mix" is dissolved; and,
5. Tilting geometrically-shaped planar substrate 20 and pouring the mixed slurry 6 (now concrete) at the desired situs.

As best seen in FIGS. 4*b* and 4*c*, the violently agitating may be carried out by rolling slurry 6 from one end to another by lifting an opposing end above the other end. Moreover, as best seen in FIGS. 5*a* and 5*b*, the violently agitating may also include rotating the wrist in the direction of ARROW 1 and/or ARROW 2 so that the slurry 6 will be rolled side to side or in other words in the direction of edge 51 and/or its opposing parallel edge.

When pouring the mixed slurry 6, edge 51 or its parallel opposing edge of geometrically-shaped planar substrate 20 may be used.

In summary, the method of mixing a mixture using my flexible mixing mat 10 comprising a geometrically-shaped planar substrate having four corner areas; four expandable corners coupled to said four corner areas, respectively; and, oblong apertures wherein a respective oblong aperture is formed in a respective one of said four expandable corners and forms a handle, comprises in general the steps of:

(a) placing a given amount of a first ingredient of a mixture substantially in a center of geometrically-shaped planar substrate 20;

(b) adding a given amount of a second ingredient to said first ingredient to create the mixture;

(c) lifting geometrically-shaped planar substrate 20 by handles 27*a*, 27*b*, 27*c*, and 27*d* of each expandable corner 21*a*, 21*b*, 21*c*, and 21*d*; and, (d) agitating geometrically-shaped planar substrate 20 until said mixture of said first and second ingredients is substantially dissolved or homogenous forming a mixed mixture.

The method further includes the step of: (e) tilting said geometrically-shaped planar substrate and pouring the mixed mixture.

As can be readily seen, using the method to create concrete would require said first ingredient to be a dry pre-blended cement composition, said second ingredient to be water, said mixture to be a slurry and said mixed mixture would then be cement.

Thus for cement, the step of (d) includes the steps of: (d1) rolling slurry 6 from one end of geometrically-shaped planar substrate 20 to another end thereof by lifting said one end above said another end; and, (d2) rolling said slurry 6 by rotating at least a pair of said four expandable corners 21*a* and 21*b* and/or 21*c* and 21*d* from one side of geometrically-shaped planar substrate 20 to another side thereof.

The step of (c) comprises the step of: (c1) lifting geometrically-shaped planar substrate 20 approximately waist-high.

The step of (c) may alternately comprise the steps of: (c1) securing a first pair of said four expandable corners by placing a first respective pair of said oblong apertures on hooking members; and, (c2) placing a pair of hands in a second pair of said oblong apertures and lift said geometrically-shaped planar substrate.

As can be seen, flexible mixing mat 10 and its method of use allow quick and easy mixing of "ready mix" concrete without bulky and costly tools and little lifting and no blisters. While the exemplary embodiment describes in detail the mixing of concrete, other mixtures may be likewise mixed.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A flexible mixing mat comprising:

(a) a geometrically-shaped planar substrate having four corner areas;

(b) four expandable corners coupled to said four corner areas, respectively; and, (c) handle means formed in a respective one of said four expandable corners from which said geometrically-shaped planar substrate is adapted to be lifted, said handle means comprising:

oblong apertures wherein a respective oblong aperture is formed in a respective one of said four expandable corners, each corner area of said four corner areas of said geometrically-shaped planar substrate has formed therein a triangularly-shaped notch having an apex located a distance from an edge of said geometrically-shaped planar substrate; and, wherein each expandable corner of said four expandable corners comprises a pleated flexible member expandable greater than said triangularly-shaped notch, wherein said pleated flexible member has formed therein said respective oblong aperture and wherein a center of a longitudinal length of said oblong aperture is substantially aligned with said apex.

2. The mat of claim 1, wherein said geometrically-shaped planar substrate is rectangularly shaped and said triangularly-shaped notch is an acute angle notch having one leg perpendicular to a short edge of said geometrically-shaped planar substrate.

3. The mat of claim 1, wherein said geometrically-shaped planar substrate is made of flexible and waterproof material.

4. The mat of claim 1, wherein said geometrically-shaped planar substrate is made of tarpaulin material.

5. The mat of claim 1, wherein each corner area of said four corner areas of said geometrically-shaped planar substrate has formed therein a triangularly-shaped notch having an apex a distance from an edge of said geometrically-shaped planar substrate wherein said apex of said triangularly-shaped notch of said each corner area of said four corner areas is adapted to create a folding point and wherein pairs of said apexes form folding lines.

6. A flexible mixing mat comprising:

(a) a geometrically-shaped planar substrate having for corner areas wherein each corner area of said four corner areas has formed therein a triangularly-shaped notch having an apex located a distance from an edge of said geometrically-shaped planar substrate;

(b) four expandable corners coupled to said four corner areas, respectively wherein each expandable corner of said four expandable corner of said four expandable corners comprises a pleated flexible member expandable greater than said triangularly-shaped notch wherein said pleated flexible member; and (c) handle means connected to respective one of said four expandable corners from which said geometrically-shaped planar substrate is adapted to be lifted wherein the point of said connection of said handle means to said one of said corners is substantially aligned with said apex.

7. The mat of claim 6, wherein said geometrically-shaped planar substrate is rectangularly shaped and said triangularly-shaped notch is an acute angle notch having one leg perpendicular to a short edge of said geometrically-shaped planar substrate.

8. The mat of claim 6, wherein said geometrically-shaped planar substrate is made of flexible and waterproof material.

9. The mat of claim 6, wherein said geometrically-shaped planar substrate is made of tarpaulin material.

10. The mat of claim 6, wherein said apex of said triangularly-shaped notch of said each corner area of said four corner areas is adapted to create a folding point and wherein pairs of said apexes form folding lines.

11. The mat of claim 6, wherein said handle means comprises:

(a) a U-shaped channel having an aperture through its center region for alignment with an aperture in a respective one of said four expandable corners;

(b) fastening means passing through said aligned apertures for connecting said corner to said channel; and, (c) a transverse slot provided in the proximate end of said channel for grasping by a user of said mat.

12. The mat of claim 11, wherein said fastener is an elongated pin having a head integral with two prongs which can be bent after passing through said aligned apertures.

13. The mat of claim 11, wherein said fastener is an rubber plug having end portions which expand after passing through said aligned apertures to prevent removal thereof.

14. A method of mixing using a flexible mixing mat comprising a geometrically-shaped planar substrate having four corner areas; four expandable corners coupled to said four corner areas, respectively; and, handle means formed in a respective one of said four expandable corners and comprising oblong apertures wherein a respective oblong aperture is formed in a respective one of said four expandable corners, said method comprising the steps of:

(a) placing a given amount of a first ingredient of a mixture substantially in a center of said geometrically-shaped planar substrate;

(b) adding a given amount of a second ingredient to said first ingredient to create a mixture, said first ingredient being a dry pre-blended cement composition, and, said second ingredient being water, said mixture being a slurry and said mixed mixture being cement;

(c) lifting said geometrically-shaped planar substrate by said handle means of each expandable corner, said lifting step further comprising the steps of:

(c1) securing a first pair of said four expandable corners by a first respective pair of said oblong apertures; and, (c2) securing a second pair of said oblong apertures and lifting said geometrically-shaped planar substrate;

(d) agitating said geometrically-shaped planar substrate until substantially said mixture of said first and second ingredients is substantially dissolved or homogenous forming a mixed mixture; and, (e) tilting said geometrically-shaped planar substrate and pouring the mixed substance.

15. The method of claim 14, wherein said step of (d) includes the steps of:

(d1) rolling said slurry from one end of said geometrically-shaped planar substrate to another end thereof by lifting said one end above said another end; and, (d2) rolling said slurry by rotating at least a pair of said four expandable corners from one side of said geometrically-shaped planar substrate to another side thereof.

16. The method of claim 14, wherein said step of (c) comprises the step of:

(c1) lifting said geometrically-shaped planar substrate approximately waist-high.

17. The method of claim 14, wherein said step of (c) further comprises the steps of:

(c1) securing a first pair of said four expandable corners by placing a pair of hands in a first respective pair of said oblong apertures and lifting said geometrically-shaped planar substrate; and, (c2) placing a pair of hands in a second pair of said oblong apertures and lift said geometrically-shaped planar substrate.

* * * * *